US009393624B2

(12) United States Patent
Lee et al.

(10) Patent No.: US 9,393,624 B2
(45) Date of Patent: Jul. 19, 2016

(54) PREPARATION METHOD OF SILVER NANOWIRES

(71) Applicant: TAIWAN TEXTILE RESEARCH INSTITUTE, New Taipei (TW)

(72) Inventors: Shiao-Yen Lee, New Taipei (TW); Jui-Chi Lin, New Taipei (TW); Pei-Fen Yang, New Taipei (TW); Ting-Yu Wu, New Taipei (TW); Yi-Hsiang Hsu, New Taipei (TW)

(73) Assignee: TAIWAN TEXTILE RESEARCH INSTITUTE, New Taipei (TW)

( * ) Notice: Subject to any disclaimer, the term of this patent is extended or adjusted under 35 U.S.C. 154(b) by 364 days.

(21) Appl. No.: 14/247,358

(22) Filed: Apr. 8, 2014

(65) Prior Publication Data

US 2015/0107412 A1 Apr. 23, 2015

(30) Foreign Application Priority Data

Oct. 21, 2013 (TW) ..... 102137923 A

(51) Int. Cl.

| | |
|---|---|
| ***B22F 9/06*** | (2006.01) |
| ***B22F 9/24*** | (2006.01) |
| *B22F 1/00* | (2006.01) |

(52) U.S. Cl.

CPC ... *B22F 9/24* (2013.01); *B22F 9/06* (2013.01); *B22F 1/0025* (2013.01); *B22F 2998/10* (2013.01); *B22F 2999/00* (2013.01)

(58) Field of Classification Search

CPC ..... B22F 9/06; B22F 9/24

See application file for complete search history.

(56) References Cited

U.S. PATENT DOCUMENTS

| | | | | |
|---|---|---|---|---|
| 7,922,787 | B2 * | 4/2011 | Wang | B22F 9/24 75/371 |
| 8,043,800 | B2 * | 10/2011 | Naoi | G03C 1/853 427/58 |
| 8,052,773 | B2 | 11/2011 | Takada | |
| 8,298,743 | B2 * | 10/2012 | Naoi | G03F 7/0047 430/165 |
| 8,613,887 | B2 * | 12/2013 | Whitcomb | B22F 1/0025 420/590 |
| 2005/0056118 | A1 * | 3/2005 | Xia | B22F 1/0007 75/330 |
| 2008/0210052 | A1 | 9/2008 | Allemand | |
| 2011/0048170 | A1 | 3/2011 | Bhatia et al. | |

(Continued)

FOREIGN PATENT DOCUMENTS

| | | | |
|---|---|---|---|
| CN | 102600839 | A | 7/2012 |
| CN | 103084584 | A | 5/2013 |
| CN | 103100724 | A | 5/2013 |

(Continued)

OTHER PUBLICATIONS

Shao et al. Preparation of Ultrafine Nanopowder by Ultrasonic Atomization Method, Jiangsu University Master's Dissertation, May 2008.

(Continued)

*Primary Examiner* — Colleen Dunn

(74) *Attorney, Agent, or Firm* — McClure, Qualey & Rodack, LLP

(57) ABSTRACT

A preparation method of silver nanowires is provided. First, droplets of an ethylene glycol solution of silver nitrate is atomized by ultra-sonication and then added into a heated solution containing polyvinylpyrrolidone and sodium chloride to form silver nanowires. Comparing with the method without the ultra-sonication, the above method can increase the yield and the aspect ratio of the silver nanowires.

9 Claims, 5 Drawing Sheets

(56) References Cited

U.S. PATENT DOCUMENTS

| | | | | |
|---|---|---|---|---|
| 2012/0063948 | A1 | 3/2012 | Ramsden et al. | |
| 2013/0152737 | A1* | 6/2013 | Chen | B22F 9/18 75/370 |

FOREIGN PATENT DOCUMENTS

| | | | |
|---|---|---|---|
| TW | 201219133 | A | 5/2012 |
| TW | 201226327 | | 7/2012 |
| TW | I372666 | | 9/2012 |

OTHER PUBLICATIONS

Lee et el. "Highly Stretchable and Highly Conductive Metal Electrode by Very Long Metal Nanowire Percolation Network" Adv. Mater. 2012, 24, 3326-3332.

English translation of abstract of TW 201226327 A1 (published Jul. 1, 2012).

English translation of abstract of TW I372666 A1 (published Sep. 21, 2012).

* cited by examiner

PREPARATION METHOD OF SILVER NANOWIRES

CROSS-REFERENCE TO RELATED APPLICATION

This application claims the priority benefit of Taiwanese application serial no. 102137923, filed Oct. 21, 2013, the full disclosure of which is incorporated herein by reference.

BACKGROUND

1. Technical Field

The disclosure relates to a preparation method of metal nanowires. More particularly, the disclosure relates to a preparation method of silver nanowires.

2. Description of Related Art

Transparent conductive material, such as transparent conductive film, can be applied on many products, such as flat panel displays, touch panels, and solar panels. Therefore, the demand of transparent conductive material is growing. At present, transparent material mainly uses indium tin oxide (ITO). However, the high price and restricted supply of indium, the brittleness of the ITO thin film, the expensive equipments and the strict deposition conditions needed by the ITO thin film, the production cost of ITO thin film is still kept quite high. Therefore, how to reduce the production cost and stabilize the preparation conditions of transparent conductive film is always an important technical issue of commercialization.

Recently, a transparent conductive film containing silver nanowires was found to be a potential candidate to replace ITO film. The light transparency can be adjusted by adjusting the concentration of silver nanowires in the transparent conductive film. The conductivity can be adjusted by the concentration of silver nanowires in the transparent conductive film and the aspect ratio of the silver nanowires.

SUMMARY

Accordingly, in one aspect, the present disclosure is directed to a preparation method to get high yield and high quality of silver nanowires.

The preparation method comprises the steps below. First, ethylene glycol solutions of polyvinylpyrrolidone (PVP), sodium chloride (NaCl), and silver nitrate ($AgNO_3$) are respectively prepared. Then, the glycerol solution of PVP is heated to a temperature of 155-165° C., and the temperature is maintained until the reaction is ended. The glycerol solution of NaCl is added into the heated glycerol solution of PVP to form a mixture solution. Next, the droplets of the glycerol solution of $AgNO_3$ is atomized to form atomized droplets in micronmeter's scale. The atomized droplets above are added into the mixture solution to form a reaction solution and to form a plurality of silver nanowire. Finally, the reaction solution is cooled down and the silver nanowires are purified.

According to an embodiment, the glycerol solution of $AgNO_3$ is atomized by ultra-sonication.

According to another embodiment, the frequency of the ultra-sonication is 25-120 KHz.

According to yet another embodiment, the power of the ultra-sonication is 1-7 W.

According to yet another embodiment, the dimension of the atomized droplets is 20-80 μm.

According to yet another embodiment, the addition rate of the atomized droplets of the silver nitrate glycerol solution is $3.79\times10^{-4}$-$4.66\times10^{-3}$ M/min.

The foregoing presents a simplified summary of the disclosure in order to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later. Many of the attendant features will be more readily appreciated as the same becomes better understood by reference to the following detailed description considered in connection with the accompanying drawings.

DETAILED DESCRIPTION

Figure 1:
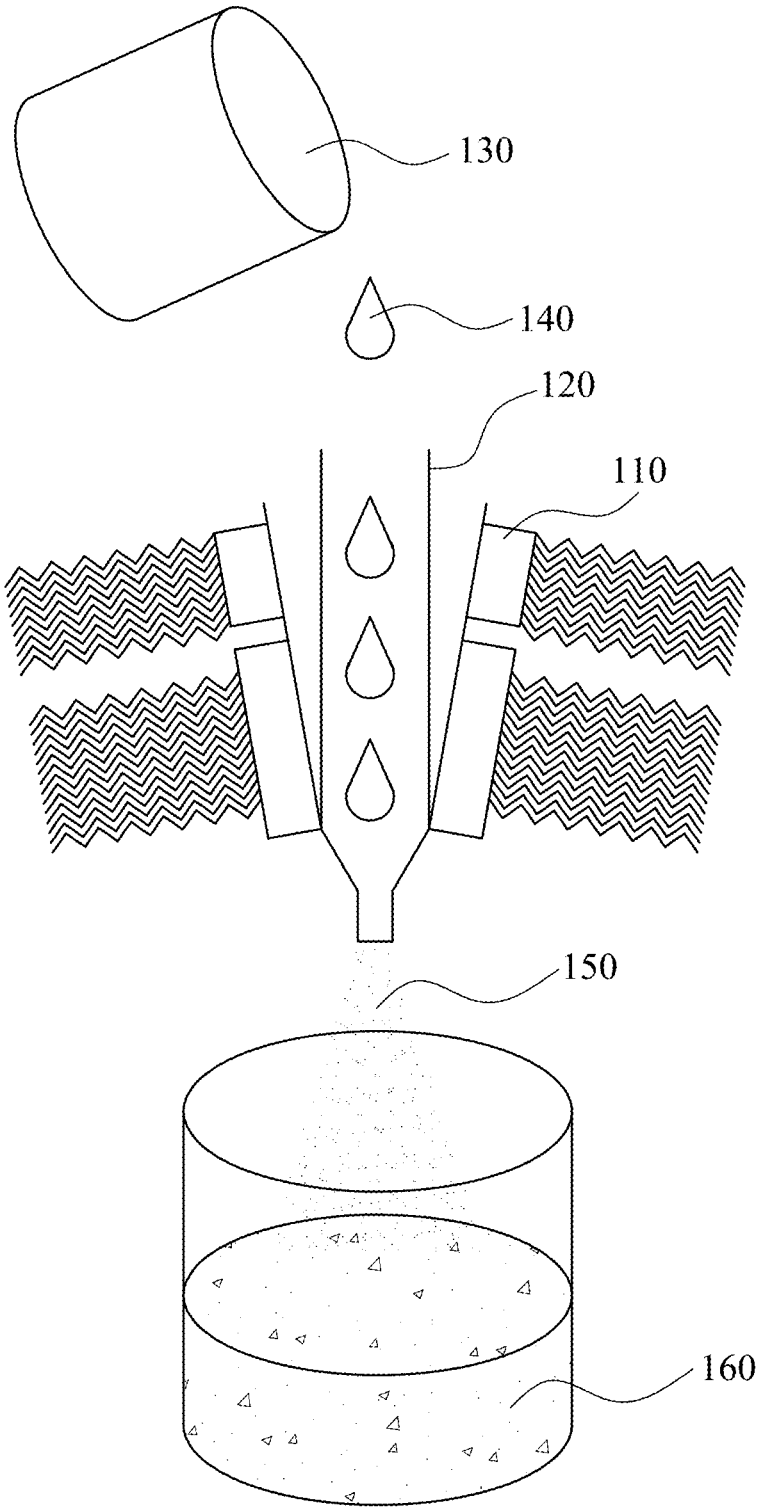
FIG. 1 is a diagram of adding a glycerol solution of silver nitrate into a mixture solution containing other reagents.

Accordingly, a preparation method of silver nanowires is provided. The yield of silver nanowires prepared by this method is greater than 70%, and the aspect ratio of the silver nanowires can be as high as 400. In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Preparation Method of Silver Nanowires

First, ethylene glycol solutions of polyvinylpyrrolidone (PVP), sodium chloride (NaCl), and silver nitrate ($AgNO_3$) are respectively prepared. The concentration of the PVP glycerol solution is 0.05-0.5 M. The concentration of the NaCl glycerol solution is $2.1\times10^{-4}$-$1.0\times10^{-2}$ M. The concentration of the silver nitrate glycerol solution is $5.0\times10^{-4}$-0.3 M.

Next, the PVP glycerol solution is heated to 155-165° C. for 10-50 minutes to completely dissolve the PVP. Then, the glycerol solution of NaCl is added into the PVP glycerol solution and continuously heating for 10-30 minutes to completely dissolve the NaCl.

FIG. 1 is a diagram of adding a glycerol solution of silver nitrate into a mixture solution containing other reagents. In FIG. 1, a dropping device 120 equipped with an ultrasonic oscillator 110 is used to atomize the droplets 140 of the silver nitrate glycerol solution 130 to form atomized droplets 150. The dimension of the atomized droplets 150 is in micronmeter's scale. The atomized droplets 150 are then added into the mixture solution 160 containing other reagents to form a reaction solution. The reaction solution is stirred at a rate of 150-500 rpm. The addition rate of the atomized droplets 150 of the silver nitrate glycerol solution 130 is $3.79\times10^{-4}$-$4.66\times10^{-3}$ M/min. When the color of the reaction solution become silver gray, the reaction solution is stirred for another 0.5-2.0 hours and the reaction will be self-terminated.

Subsequently, the reaction solution is centrifuged at a rate of 5000-10000 rpm for 10-60 minutes. The silver nanowires are precipitated to the bottom of the centrifuge tubes. Finally, a filter membrane (pore diameter 0.02-5 μm) is used to remove contaminated silver nanoparticles to purify the silver nanowires.

Embodiment 1

Effect of Ultra-sonication Frequency on the Dimension of Atomized Droplets and the Formation of Silver Nanowires The power of the ultrasound used for the ultra-sonication was fixed at 6.2 W first, and the frequency of the ultrasound was varied to see the effect of the ultrasound frequency on the dimension of atomized droplets and the formation of silver nanowires.

The silver nanowires were prepared by the method described above. The concentration of the PVP glycerol solution was 0.15 M. The concentration of the NaCl glycerol solution was $2.1\times10^{-3}$ M. The concentration of the silver nitrate glycerol solution was 0.091 M. The addition rate of the silver nitrate glycerol solution was $2.45\times10^{-3}$ M/min. The reaction temperature was 160±1° C. The stirring rate was 200 rpm.

The obtained results are listed in the Table 1 below. Comparing the comparing example, example 1 and example 2, it can be known that the aspect ratio and the yield of the obtained silver nanowires could be raised when the droplets of the silver nitrate glycerol solution were atomized before adding into the mixture solution containing other reagents. Comparing examples 1 and 2, it can be known that when the ultrasound frequency was increased, the dimension of the droplets of the silver nitrate glycerol solution was decreased, as well as the aspect ratio and the yield of the silver nanowires were increased.

TABLE 1

Effect of ultrasound frequency on the dimension of atomized droplets and the formation of silver nanowires

Figure 2:
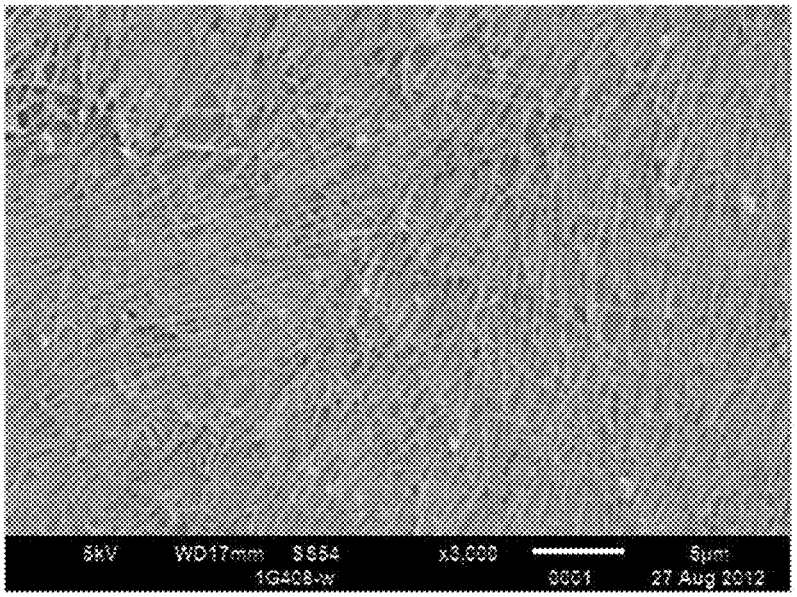
FIGS. 2-7 are scanning electron micrographs of examples 2-6 in this disclosure.
Figure 3:
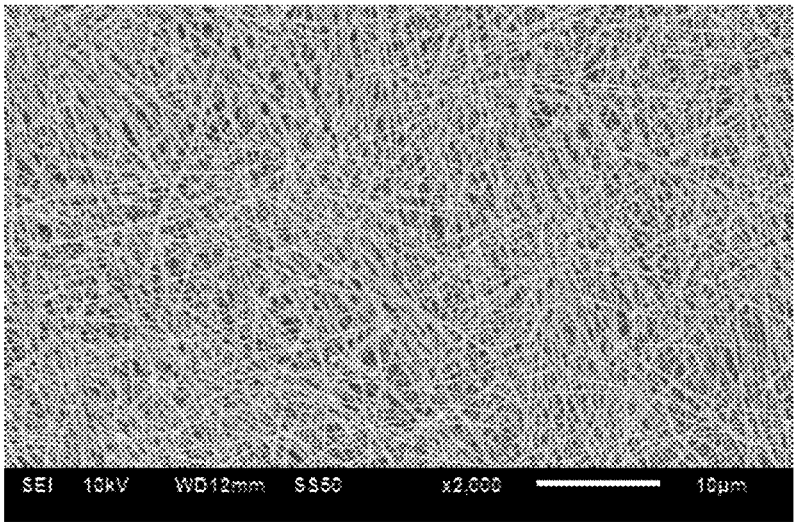

| | Comparing example | Example 1 | Example 2 |
|---|---|---|---|
| Ultrasound frequency (KHz) | 0 | 25 | 48 |
| Dimension of Droplets/atomized droplets (μm) | 1,000-2,000 | 70-80 | 30-40 |
| Aspect ratio of silver nanowires | 50-200 | 100-300 | 187-400 |
| yield | <50% | <70% | >70% |
| SEM of product | FIG. 2 | — | FIG. 3 |

Embodiment 2

Effect of Addition Rate of Silver Nitrate Glycerol Solution on the Formation of Silver Nanowires In this embodiment, silver nanowires were prepared by the method described above. The concentration of the PVP glycerol solution was 0.15 M. The concentration of the NaCl glycerol solution was $2.1\times10^{-3}$ M. The reaction temperature was 160±1° C. The stirring rate was 200 rpm. The ultrasound frequency was 48 kHz, and the ultrasound power was 6.2 W.

The addition rate of the silver nitrate glycerol solution was calculated by the formula of $N_{add}/(V_{tot}\times t_{add})$. In this formula, the total adding molar number of the silver nitrate is denoted by $N_{add}$, the total volume of the ethylene glycol solution containing other reagents, i.e. the total volume of the mixture solution 160 in FIG. 1, is denoted by $V_{tot}$, and the total adding time is denoted by $t_{add}$. The obtained results are listed in the Table 2 below.

TABLE 2

Effect of addition rate of silver nitrate glycerol solution on the formation of silver nanowires

Figure 4:
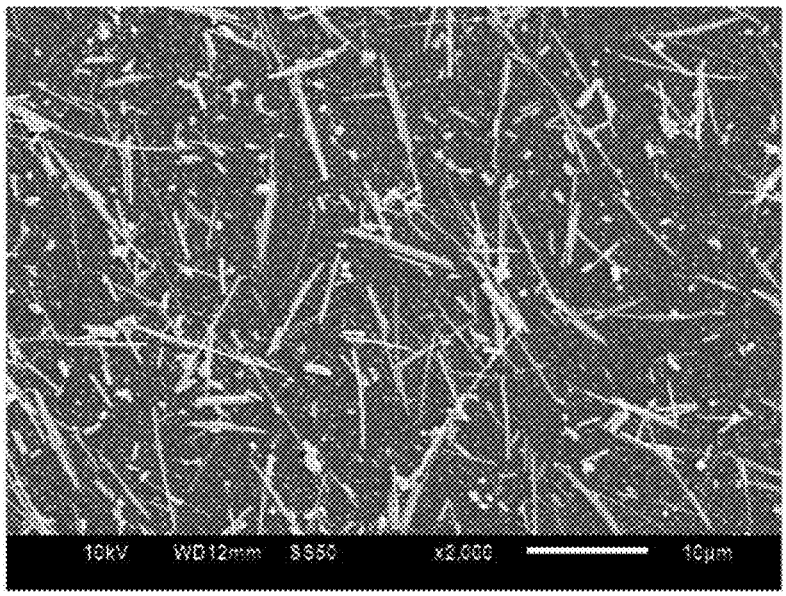
Figure 5:
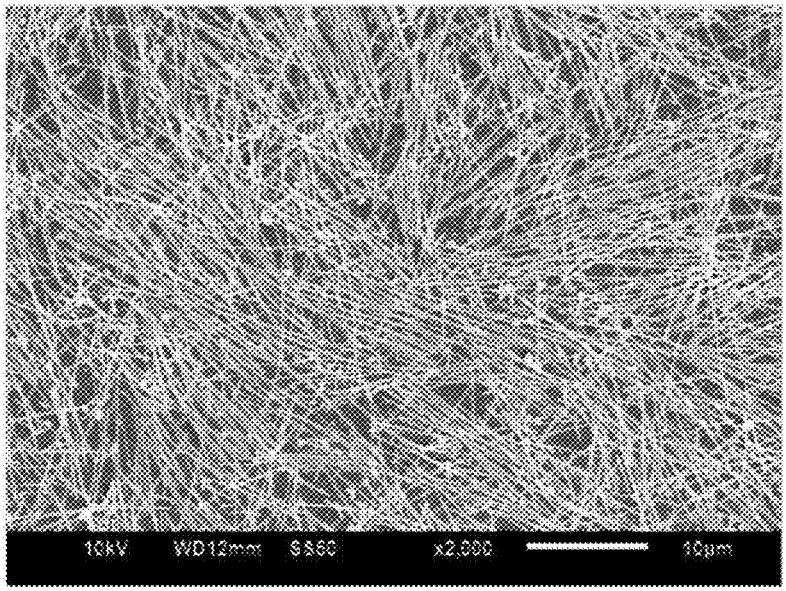
Figure 6:
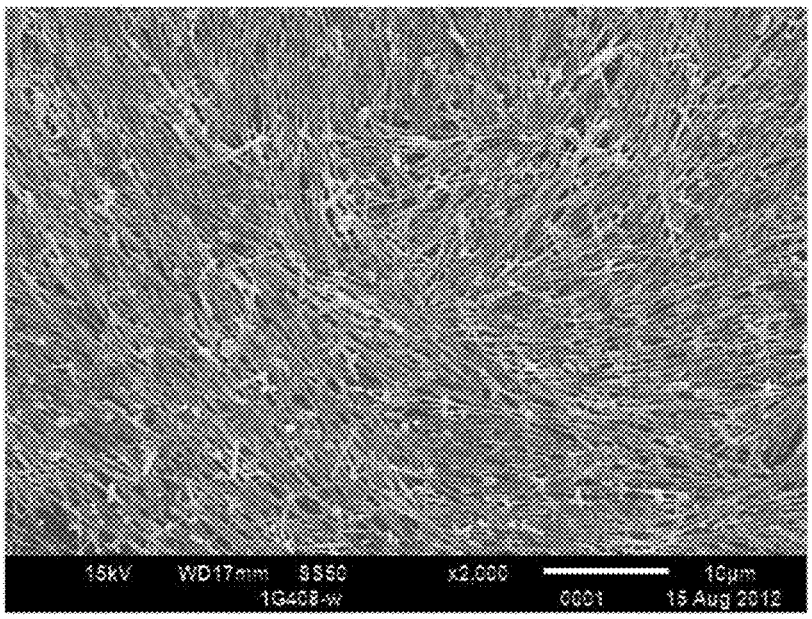
Figure 7:
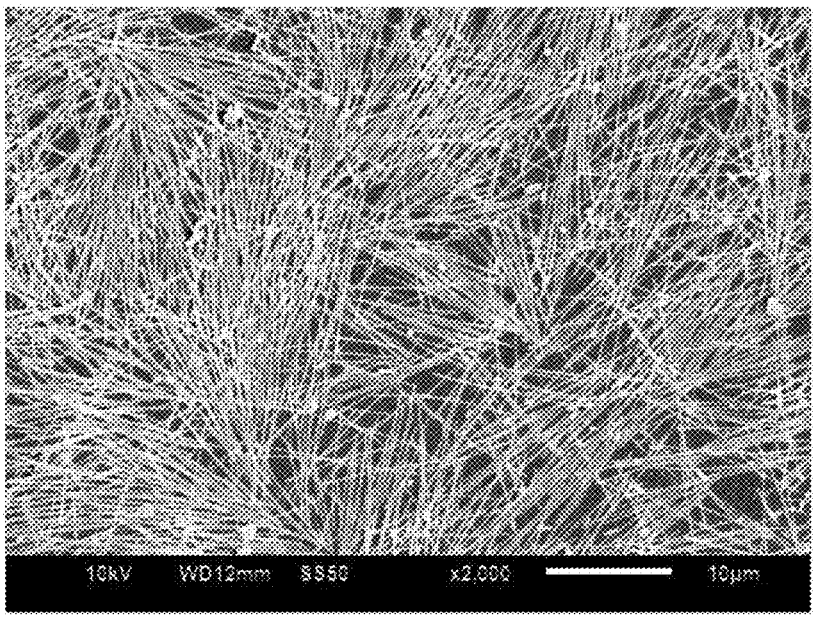

| Examples | 3 | 4 | 5 | 6 |
|---|---|---|---|---|
| Addition rate of silver nitrate glycerol solution (mM/min) | 0.379 | 1.58 | 2.45 | 4.66 |
| Aspect ratio of silver nanowires | 20-60 | 170-210 | 200-250 | 130-160 |
| SEM of product | FIG. 4 | FIG. 5 | FIG. 6 | FIG. 7 |

From the results listed in Table 2, it can be known that the aspect ratio of the silver nanowires was increased as the addition rate of the silver nitrate glycerol solution was increased (examples 3-5), and then decreased as the silver nitrate glycerol solution was further increased (examples 5-6). Accordingly, the better addition rate of the silver nitrate glycerol solution was about $1.2\text{-}5\times10^{-3}$ M/min.

Embodiment 3

Effect of Thermal Treatment Temperature on Conductivity of Silver Nanowires

In this embodiment, the conductivity of the silver nanowires after thermal treatment at various temperatures was tested. The tested silver nanowires had a length of 17-20 μm and a diameter of 100 nm. The solid content of the suspension aqueous solutions of the silver nanowires was 0.4 wt %. After weighing same weight of the suspension aqueous solutions of the sliver nanowires, the suspension aqueous solutions of the sliver nanowires were coated on a substrate and then baked at various temperatures to obtain various tested samples. After the tested samples were cooled down to room temperature, four point probes were used to test the conductivity of the tested samples. The obtained results are listed in the Table 3 below and FIG. 8.

TABLE 3

Effect of thermal treatment temperature on conductivity of silver nanowires

| Thermal treatment temperature (° C.) | Conductivity (S/cm) |
|---|---|
| 50 | 55 |
| 80 | 687 |
| 110 | 1150 |
| 150 | 1010 |
| 190 | 1470 |
| 230 | 2000 |
| 250 | 2933 |
| 280 | 644 |

Figure 8:
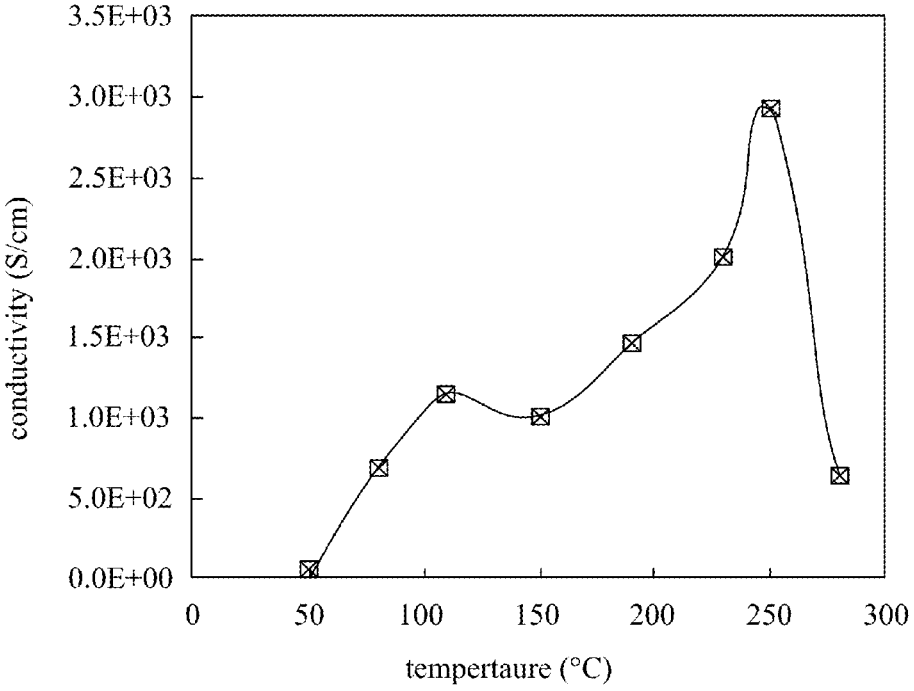
FIG. 8 is a diagram showing the effect of the thermal treatment temperature on the conductivity of the silver nanowires.

From Table 3 and FIG. 8, it can be known that the conductivity of the silver nanowires baked at a temperature at least 80° C. can be greatly increased. Especially baked at 100-260° C., the conductivity of silver nanowires can be increased to more than 1000 S/cm. This result shows that the obtained silver nanowires can be applied in a high temperature environment, which has a temperature no more than 260° C.

Accordingly, the atomized droplets and the controlled addition rate of the silver nitrate glycerol solution can be used to obtain high yield and high quality of silver nanowires.

Therefore, the preparation cost of silver nanowires can be decreased, and thus the transparent conductive film.

All the features disclosed in this specification (including any accompanying claims, abstract, and drawings) may be replaced by alternative features serving the same, equivalent or similar purpose, unless expressly stated otherwise. Thus, each feature disclosed is one example only of a generic series of equivalent or similar features.

What is claimed is:

1. A method of preparing silver nanowires, the method comprising:

respectively preparing ethylene glycol solutions of polyvinylpyrrolidone (PVP), sodium chloride (NaCl), and silver nitrate ($AgNO_3$);

heating the glycerol solution of PVP to a temperature of 155-165° C., wherein the temperature is maintained;

adding the glycerol solution of NaCl into the heated glycerol solution of PVP to form a mixture solution;

atomizing droplets of the glycerol solution of $AgNO_3$ to form atomized droplets in micronmeter's scale;

adding the atomized droplets into the mixture solution to form a reaction solution and to form a plurality of silver nanowires;

cooling the reaction solution; and purifying the silver nanowires.

2. The method of claim 1, wherein the glycerol solution of Ag $NO_3$ is atomized by ultra-sonication.

3. The method of claim 2, wherein a frequency of the ultra-sonication is 25-120 KHz.

4. The method of claim 2, wherein a power of the ultra-sonication is 1-7 W.

5. The method of claim 1, wherein a dimension of the atomized droplets is 20-80 μm.

6. The method of claim 1, wherein an addition rate of the atomized droplets of the silver nitrate glycerol solution is $3.79\times10^{-4}$-$4.66\times10^{-3}$ M/min.

7. The method of claim 1, wherein the concentration of the PVP glycerol solution is 0.05-0.5 M.

8. The method of claim 1, wherein the concentration of the NaCl glycerol solution is $2.1\times10^{-4}$-$1.0\times10^{-2}$ M.

9. The method of claim 1, wherein the concentration of the silver nitrate glycerol solution is $5.0\times10^{-4}$-0.03 M.

* * * * *